US011311756B1

(12) United States Patent
Varga

(10) Patent No.: US 11,311,756 B1
(45) Date of Patent: Apr. 26, 2022

(54) BALLASTED FALL PREVENTION APPARATUS

(71) Applicant: DIADEM USA, INC., Portland, OR (US)

(72) Inventor: Gabor Varga, Portland, OR (US)

( * ) Notice: Subject to any disclaimer, the term of this patent is extended or adjusted under 35 U.S.C. 154(b) by 251 days.

(21) Appl. No.: 16/384,354

(22) Filed: Apr. 15, 2019

Related U.S. Application Data

(60) Provisional application No. 62/658,895, filed on Apr. 17, 2018.

(51) Int. Cl.
*A62B 35/04* (2006.01)
*A62B 35/00* (2006.01)

(52) U.S. Cl.
CPC ..... *A62B 35/0068* (2013.01); *A62B 35/04* (2013.01)

(58) Field of Classification Search
CPC ..... A62B 35/0068; A62B 35/04; A62B 35/00; C08G 18/10; C08G 21/328; C08G 21/329; C08G 21/20; E06B 7/28; A47G 29/02
USPC ..... 248/542, 636, 237, 688; 182/4; 267/294, 267/141, 149, 152, 162
See application file for complete search history.

(56) References Cited

U.S. PATENT DOCUMENTS 3,880,405 A * 4/1975 Brueske ..... E04G 21/3295 256/59
4,003,553 A 1/1977 Morris
4,437,642 A * 3/1984 Holt ..... B66C 1/66 249/175
4,462,573 A 7/1984 Melfi et al.
4,932,185 A * 6/1990 Lebel ..... A47L 3/04 52/37
4,942,943 A 7/1990 Flaherty
5,011,106 A * 4/1991 Cody ..... A62B 35/0068 182/3
5,090,503 A 2/1992 Bell
5,143,170 A * 9/1992 Hunt ..... A62B 35/04 182/3

(Continued)

OTHER PUBLICATIONS

KeeGuard Contractor guardrail system. Kee Safety, Inc. Buffalo, NY. https://www.keesafety.com/products/keeguard_contractor.

(Continued)

*Primary Examiner* — Nkeisha Smith
(74) *Attorney, Agent, or Firm* — Small Business Legal Clinic; Jessica Ann Bernardini; Daniel C. Housley

(57) ABSTRACT

A rooftop safety system for protecting persons from falling off a rooftop environment by employing fall protection which may include a ballasted fall prevention apparatus, and a fall protection anchor coupled to the ballasted fall prevention apparatus. A fall protection anchor may include an attachment device adapted to couple the fall protection anchor to a structure, an anchorage connector adapted to connect personal fall protection equipment to the fall protection anchor to deploy fall restraint. In one embodiment, an integral strain indicator made of a degradable material is placed within the fall protection anchor, and after a certain amount of force indicative of a fall impact is reached, deforms giving a visual indication to safety inspectors that a fall event has occurred. In an alternative embodiment the strain indicator can be formed into a housing which covers an attachment device as well as the post the attachment device is attached to.

13 Claims, 15 Drawing Sheets

(56) References Cited

U.S. PATENT DOCUMENTS 5,143,171 A * 9/1992 Glynn ..... A62B 35/04 182/3
5,182,889 A * 2/1993 Johnson ..... E04G 21/3219 52/298
5,220,977 A 6/1993 Wolner
5,287,944 A 2/1994 Woodyard
5,553,685 A 9/1996 Cook
5,603,389 A 2/1997 Zemon
5,694,720 A * 12/1997 Walcher ..... A62B 35/0068 52/111
5,699,875 A * 12/1997 Dugan ..... A62B 35/0068 182/3
5,967,722 A * 10/1999 Fett ..... F16B 39/10 411/120
6,053,281 A 4/2000 Murray
6,148,580 A * 11/2000 Weir ..... A62B 35/0056 52/651.1
6,244,804 B1 * 6/2001 Hodge ..... F16B 31/02 116/212
6,406,002 B1 6/2002 Hardy, III et al.
6,478,112 B2 11/2002 Lee
6,578,827 B2 6/2003 McCracken
6,585,080 B2 7/2003 Murray
6,779,316 B2 * 8/2004 Carroll ..... E04G 21/3261 411/340
6,966,531 B2 * 11/2005 Curtin ..... E04G 21/3261 248/237
7,063,186 B1 6/2006 Granke
7,163,083 B2 * 1/2007 Argoud ..... A62B 35/04 182/113
7,240,770 B2 7/2007 Mullins et al.
7,537,085 B2 * 5/2009 Vetesnik ..... A62B 35/0068 182/3
7,665,248 B2 * 2/2010 Blackford ..... E04D 13/12 52/27
7,802,773 B2 * 9/2010 Murphy ..... E04G 21/3223 256/65.14
7,934,701 B2 5/2011 Kay
8,025,125 B2 * 9/2011 Vetesnik ..... E04G 21/3276 182/45
8,132,792 B2 * 3/2012 Perris ..... E04G 21/3276 256/65.14
8,359,792 B1 * 1/2013 Atchley ..... E04H 12/20 52/149
8,387,752 B2 * 3/2013 Lagerstedt ..... E04G 21/3261 182/87
8,397,351 B2 * 3/2013 Lara ..... A62B 35/0093 24/134 R
8,424,638 B1 * 4/2013 Guthrie ..... A62B 35/0068 182/3
8,636,266 B2 1/2014 Gill
8,646,575 B1 2/2014 Guthrie et al.
8,656,652 B1 2/2014 Carrillo
8,708,099 B2 4/2014 Fortin
8,757,566 B2 6/2014 Nash
8,882,083 B2 11/2014 Ramskov
8,997,317 B2 4/2015 Rinklake
9,067,089 B2 6/2015 Hirst
9,149,670 B1 10/2015 Walker et al.
9,431,809 B2 * 8/2016 Vogel ..... H02G 3/30
9,464,440 B2 10/2016 Whiting
9,480,367 B2 11/2016 Reed
9,616,255 B1 4/2017 Liddle
9,617,747 B2 4/2017 Seto et al.
9,878,187 B2 * 1/2018 Sargent ..... E04G 21/3261
9,885,197 B2 * 2/2018 Pettlon, II ..... E04F 11/18
10,213,632 B2 * 2/2019 Gooder ..... A62B 35/0068
10,232,201 B2 * 3/2019 Wells ..... A62B 35/0068
10,415,261 B2 * 9/2019 Allen ..... A62B 35/0068
10,512,802 B2 * 12/2019 Patton ..... A62B 35/0056
10,532,235 B2 * 1/2020 Linton ..... E04G 21/3276
10,576,315 B2 * 3/2020 Pascoe ..... F16B 31/028
2002/0079164 A1 * 6/2002 Choate ..... F16G 11/06 182/36
2003/0151180 A1 * 8/2003 Renton ..... F16F 7/128 267/155
2004/0173405 A1 * 9/2004 Bove ..... E04G 21/3261 182/3
2005/0098381 A1 * 5/2005 Flaherty ..... A62B 35/0056 182/3
2007/0261915 A1 * 11/2007 Auston ..... A62B 35/0056 182/11
2008/0110117 A1 * 5/2008 O'Gorman ..... E04G 21/3276 52/344
2008/0184534 A1 * 8/2008 Lara ..... F16F 7/123 24/134 R
2009/0056083 A1 * 3/2009 Lara ..... A62B 35/0093 24/115 R
2009/0194366 A1 * 8/2009 Parker ..... A62B 35/04 182/3
2010/0126801 A1 * 5/2010 Begin ..... A62B 35/0068 182/3
2011/0005150 A1 * 1/2011 Berlee ..... E04G 21/3276 52/173.1
2012/0073900 A1 * 3/2012 Cruz ..... E04G 21/3276 182/3
2014/0001334 A1 * 1/2014 Hirst ..... A62B 35/04 248/560
2014/0191172 A1 * 7/2014 Christoffer ..... E04G 21/3223 256/21
2014/0224579 A1 * 8/2014 Balascak ..... A62B 35/0068 182/3
2014/0346312 A1 * 11/2014 Small ..... A62B 35/0068 248/573
2018/0117374 A1 * 5/2018 Pascoe ..... A62B 35/0068
2019/0030381 A1 * 1/2019 Hung ..... A62B 35/04
2019/0178279 A1 * 6/2019 Willmott ..... A62B 35/0068
2020/0078620 A1 * 3/2020 Wang ..... B65H 75/40
2020/0078621 A1 * 3/2020 Chen ..... A62B 35/0093

OTHER PUBLICATIONS

KeeGuard Safety Railing. Kee Safety, Inc., Buffalo, NY. https://www.keesafety.com/products/keeguard.
Grasping non-penetrating fall protection guardrail system. The Construction Specifier: The Official Magazine of CSI. May 8, 2017. https://www.constructionspecifier.com/grasping-non-penetrating-fall-protection-guardrail-systems/4.
Falltech. Compton, CA. http://falltech.com/Default.aspx.

* cited by examiner

BALLASTED FALL PREVENTION APPARATUS

CROSS-REFERENCE TO RELATED APPLICATIONS

This application claims priority from U.S. Provisional Patent Application No. 62/658,895 filed Apr. 17, 2018 titled Ballasted Fall Arrest Guard Rail System which is incorporated by reference.

BACKGROUND

Rooftop and other elevated environments naturally involve the dangers of users falling off of them while maintenance personnel are working in it or casual visitors are enjoying the environment. Various regulations by the Occupational Safety and Health Administration (OSHA) have been put in place to ensure the safety of those in rooftop environments, particularly maintenance and construction workers working close to roof edges and thus needing protection from fall hazards. Ballasted material works particularly well in rooftop environments as they do not penetrate the waterproof membranes that cover rooftops and prevent precipitation such as rain or snow from leaking into and damaging the building.

It is typical to have multiple safety apparatuses deployed in rooftop environments. There are various methods of preventing or halting fall events, a collective concept which may be called fall protection. When a barrier is placed between the fall user and the fall rail such as a handrail or guardrail, fall prevention may have been deployed. These barriers and others such as anchor posts and barricades are installed to restrict pedestrian traffic a safe distance from the edge of the rooftop. Other safety methods exist to protect authorized persons that need to operate outside the pedestrian areas, include tie-off systems that hold users back from reaching a fall hazard such as the edge of a ledge. These restraint systems are known as fall restraints and allow attachment to harnesses. As a last resort, tie-off or fall arrest systems can also be used to stop falls in progress.

SUMMARY

Some of the inventive principles of this patent disclosure relate to a rooftop safety system having: a ballasted fall prevention apparatus; and a fall protection anchor coupled to the ballasted fall prevention apparatus. The fall prevention apparatus may include a handrail system and/or a guard rail system. The fall protection anchor may include a fall arrest anchor. The fall protection anchor may include a fall restraint anchor. The fall protection anchor include may include an anchorage connector. fall protection anchor may include a strain indicator. The fall protection anchor may be coupled to the ballasted fall protection apparatus by a hook. The fall protection anchor may be integral with the ballasted fall protection apparatus. The hook may be welded to the ballasted fall prevention apparatus.

Some additional inventive principles of this patent disclosure relate to a fall protection anchor having: an attachment device adapted to couple the fall protection anchor to a structure; an anchorage connector adapted to connect personal fall protection equipment to the fall protection anchor; and an integral strain indicator. The strain indicator may be coupled to the attachment device and the anchorage connector. The strain indicator may be coupled between the attachment device and the anchorage connector. The attachment device may include a first end of a multi-hole link; the anchorage connector may include a second end of the multi-hole link; and the integral strain indicator may include a degradable material. The degradable material may be arranged within one of the holes. The strain indicator may include a shock absorber flanked by one or more strain covers. The shock absorber may be coiled. The one or more strain covers may degrade when a certain force is applied to the fall protection anchor, thereby signifying a fall event. The shock absorber may be flanked by one or more covers; and one or more covers may degrade when a certain force is applied to the fall protection anchor, thereby signifying a fall event.

Some additional inventive principles of this patent disclosure relate to a method including coupling personal fall protection equipment to a ballasted fall prevention apparatus. The ballasted fall prevention apparatus may include a handrail system. The ballasted fall prevention apparatus may include a guardrail system. Coupling the personal fall protection equipment to a ballasted fall prevention apparatus may include attaching personal fall protection equipment to the ballasted fall prevention apparatus via a fall protection anchor. Coupling personal fall protection equipment to a ballasted fall prevention apparatus may include: coupling a fall protection anchor to the ballasted fall prevention apparatus; and coupling personal fall protection equipment to the fall protection anchor. The personal fall protection equipment may include tie-off apparatus. The tie-off apparatus may include a harness. The fall protection anchor may include: an anchorage connection; an attachment device; and an integral strain indicator coupled to the anchorage connection and the attachment device. The ballasted fall prevention apparatus may include a strain indicator comprising one or more frangible strain covers flanking a shock absorber.

Some additional inventive principles of this patent disclosure relate to a fall protection anchor comprising: means for coupling the fall protection anchor to a structure; means for connecting personal fall protection equipment to the fall protection anchor; and integral means for indicating strain. The integral means for indicating strain may include one or more frangible covers that flank a shock absorber.

DETAILED DESCRIPTION

Figure 1:
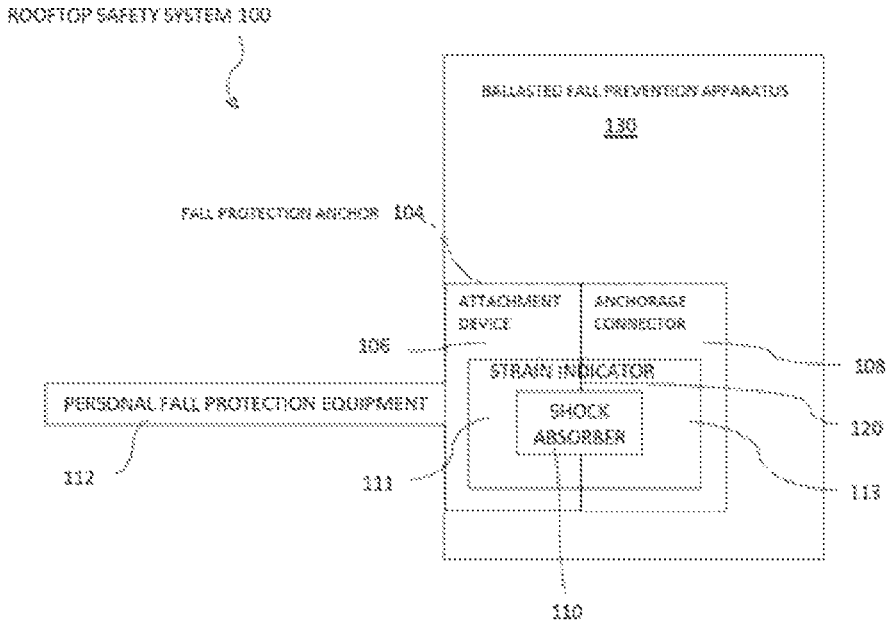
FIG. 1: A schematic block diagram of an embodiment of a system for rooftop safety according to the inventive principles of this patent disclosure.

A rooftop safety system 100 designed for protecting persons from falling off a rooftop by serving as a barrier to fall hazards as well as providing a fall protection anchor 104 for authorized personnel operating outside the guard rail, along the periphery of the rooftop. In one embodiment, a block diagram FIG. 1 illustrates a rooftop safety system ("RSS") 100 which includes a ballasted fall prevention apparatus 130 and a fall protection anchor 104 coupled to the ballasted fall prevention apparatus 130. The ballasted fall prevention apparatus 130 is designed to both prevent fall events through tie-off systems and halt fall events in progress through the attachment of personal fall protection equipment 112 to the fall protection anchor 104. The fall protection anchor 104 includes an attachment device 106 and an anchorage connector 108, with a shock absorber 110 in between them, covered by a strain indicator 120 made up of strain covers 111, 113. Personal fall protection equipment 112 may be connected to the attachment device 106. The fall protection anchor 104 couples with the ballasted fall prevention apparatus 130 which supports the weight of impact from falls via ballast material placed in a frame of ballast trays (not shown).

The RSS is a novel rooftop safety apparatus designed to integrate the functionality of multiple rooftop safety features in one installation. The RSS eliminates the need for perforations of rooftop waterproof membranes by utilizing ballast weight to affix the guard rail or handrail upright. By utilizing the vertical structure posts (element c in FIG. 2) as anchor points, The RSS eliminates the need for additional fixed anchor posts to be installed around the periphery of the rooftop. This fixed system also offers advantages over portable dead-weight fall arrest systems since it eliminates setting up and taking down weighted anchor points each time a person needs to work on a different section of the rooftop edge.

Figure 2:
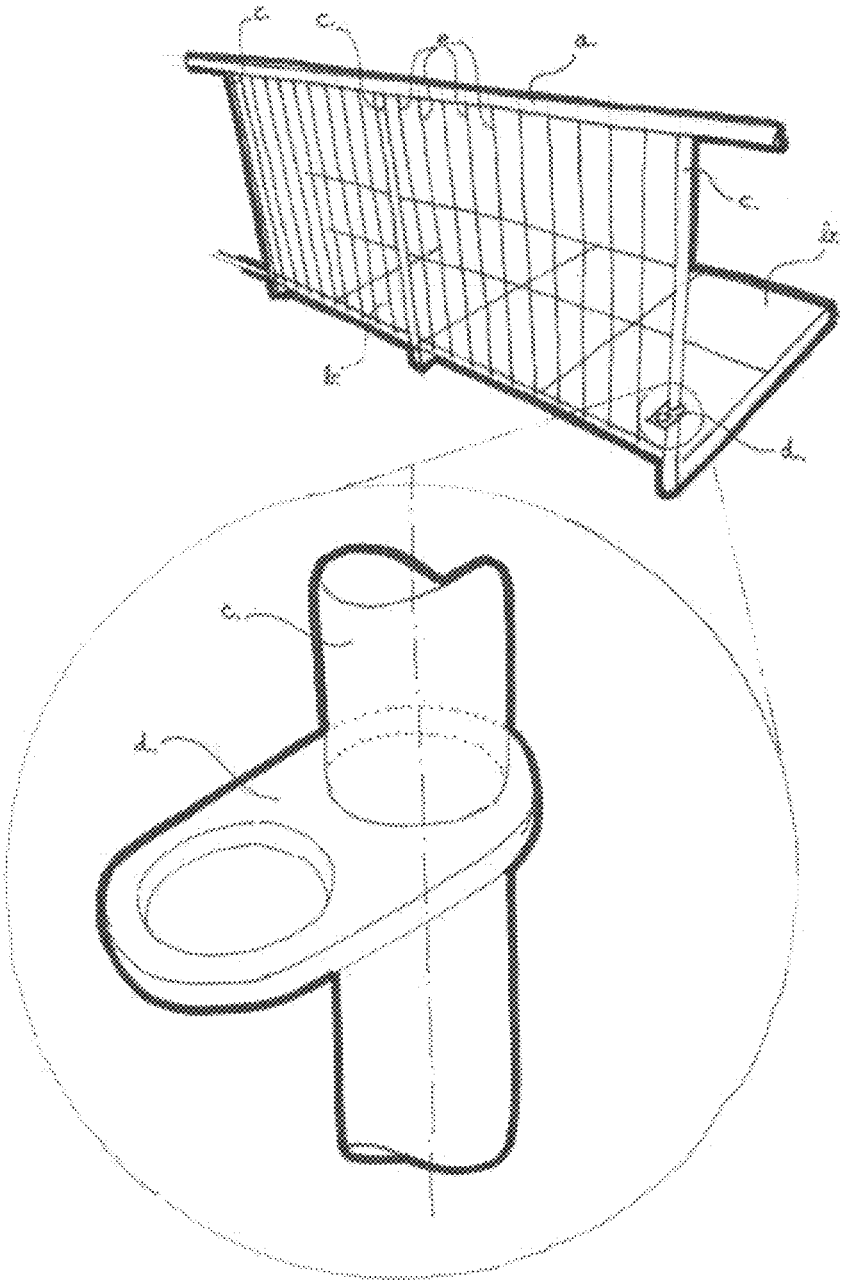
FIG. 2: An isometric view (top of FIG. 2) from edge of the rooftop of the Ballasted Fall Arrest Guard Rail System and a detail view (bottom of FIG. 2) of the attachment device for a personal safety harness and lanyard. (a) Horizontal Top Rail, (b) Ballast Material, (c) Vertical Structure Post, (d) Attachment Device, (e) Vertical Rods.
Figure 3:
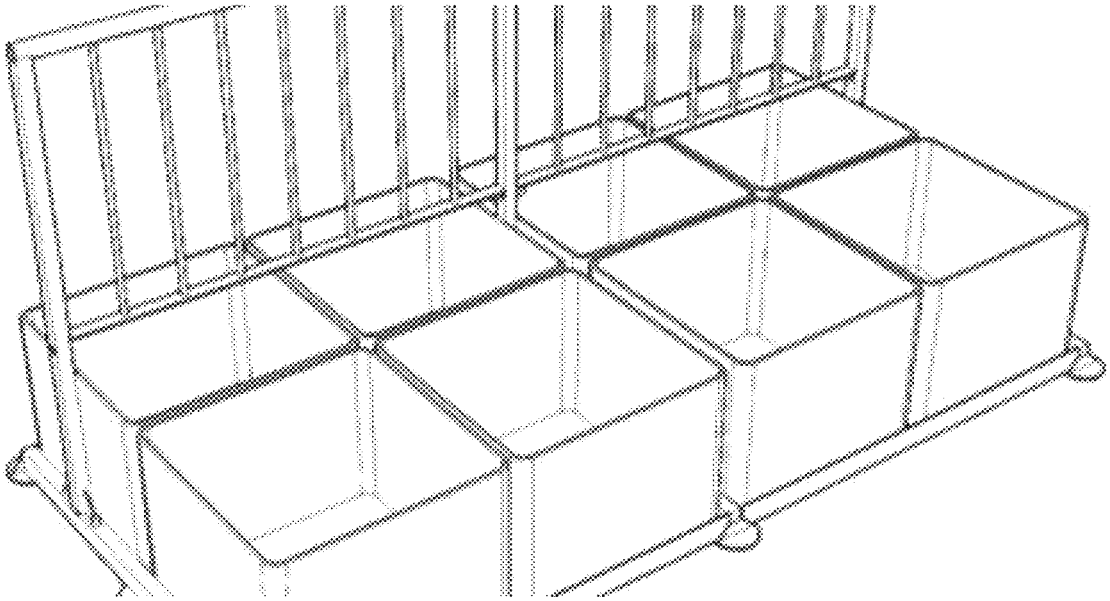
FIG. 3: An isometric view from the interior of the rooftop of the system frame with the ballast weight and other rooftop materials omitted for clarity.

In the preferred embodiment the RSS is fabricated in modular sections. These steel sections are made of a horizontal top bar (element a in FIG. 2) coupled to vertical structure posts and vertical rods (element e in FIG. 2) integrated into the system frame, which is composed of steel ballast trays and steel support feet (FIG. 3). Ballast material (element b in FIG. 2) of sufficient weight which may include soil, gravel, vegetation, and paving slabs are placed in the steel trays to secure the RSS sections in place.

The system frame can also take on many different forms. For example, it can be a circular base over which ballast material is placed or simply long horizontal rods which increase the stability of the RSS. Any similar forms of ballasted frames not mentioned explicitly, but common in usage, are contemplated within this specification.

The attachment device (element d in FIG. 2) is fixed mounted on the vertical structure posts so it cannot be removed, relocated, or repositioned. Here, the attachment device includes a first (outer) end of a multi-hole link and the anchorage connector includes a second (inner) end of the multi-hole link. Attachment devices are periodically placed along vertical structure posts. They are oriented so that the attachment device extends outwards towards the edge of the building. This enables persons who need to work outside the guard rail to connect lanyards at these points and thus safely work without tangling of said lanyards. These attachment devices are designed for carabiners, or a similar device, to be attached to a personal fall arrest harness and clip into an eyelet on the device.

Since the torque on the vertical structure post increases linearly with the vertical positioning of the attachment device, it is ideal to place the attachment device as low as possible on the post, thus minimizing both the amount of ballast material required and diameter and thickness of the vertical structure posts. However, due to ergonomics such as desiring visibility and not requiring workers bend over as low, the attachment device is optimally positioned approximately 4 inches above the ballast material (FIG. 2). However, depending on how fortified the System is, in terms of ballast weight and the overall strength of the structure posts, the vertical positioning of the attachment device can be adjusted accordingly.

Alternatively, the attachment device can take the form of a taut wire or rod which is secured between the vertical structure posts. Again, this embodiment of the attachment device is optimally positioned approximately 4 inches above the ballast material but can be adjusted based on how fortified the System is. The advantage of using a taut wire or rod is that persons working along the periphery of the rooftop can connect their personal fall arrest gear to the attachment device and gain an additional degree of linear motion along the segment between posts versus an attachment point at a fixed location.

Due to potential loss of life, there are numerous safety regulations in the field of personal fall arrest equipment. OSHA 1926.502(d)(19) requires that "Personal fall arrest systems and components subjected to impact loading shall be immediately removed from service and shall not be used again for employee protection until inspected and determined by a competent person to be undamaged and suitable for reuse." In short, prior to each use and upon any time of fall "event" the apparatus must be thoroughly inspected.

Figure 4:
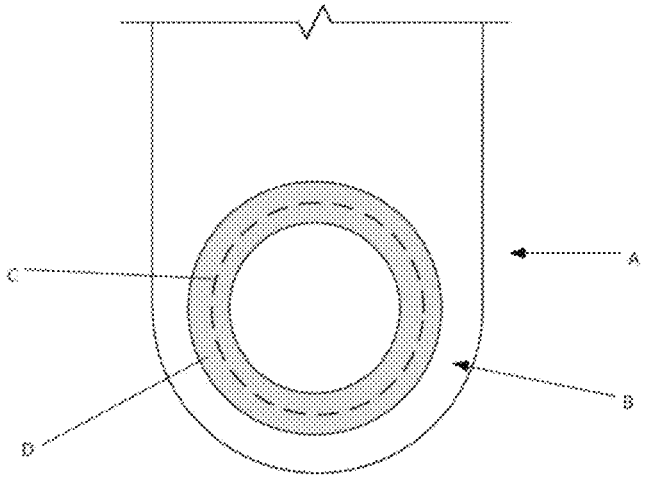
FIG. 4: A top view of strain indicator embodiment one, the strain insert, situated inside the anchor point. Only the portion of the anchor point extending past the safety rail is shown (indicated by line break).

For this reason, the apparatus also can incorporate a feature to visually notify personnel inspecting it whether a fall event has occurred. The feature utilizes a material ("Strain Indicator") that will noticeably deform after, but not before, a certain amount of force representative of a person falling off the rooftop or substantially similar "impact loading" is applied to the System. In one embodiment, FIG. 4, the Strain Indicator can be formed such that it fits into the portion of the attachment device where fall arrest gear, such as a carabiner, would attach to it. This "Strain Insert" can be adapted so that it has flanges that rest atop the attachment device. These flanges, in addition to more securely positioning the Strain Insert in place via gravitational forces, also increase the visibility of the material should a deformation occur than if the insert was simply positioned within the eyelet the carabiner attaches to. FIG. 4 includes (A) Attachment Device, (B) Strain Insert, (C) Internal Ring of Attachment Device, and (D) Strain Indicator Material. The strain indicator material is shown in grey.

Figure 5:
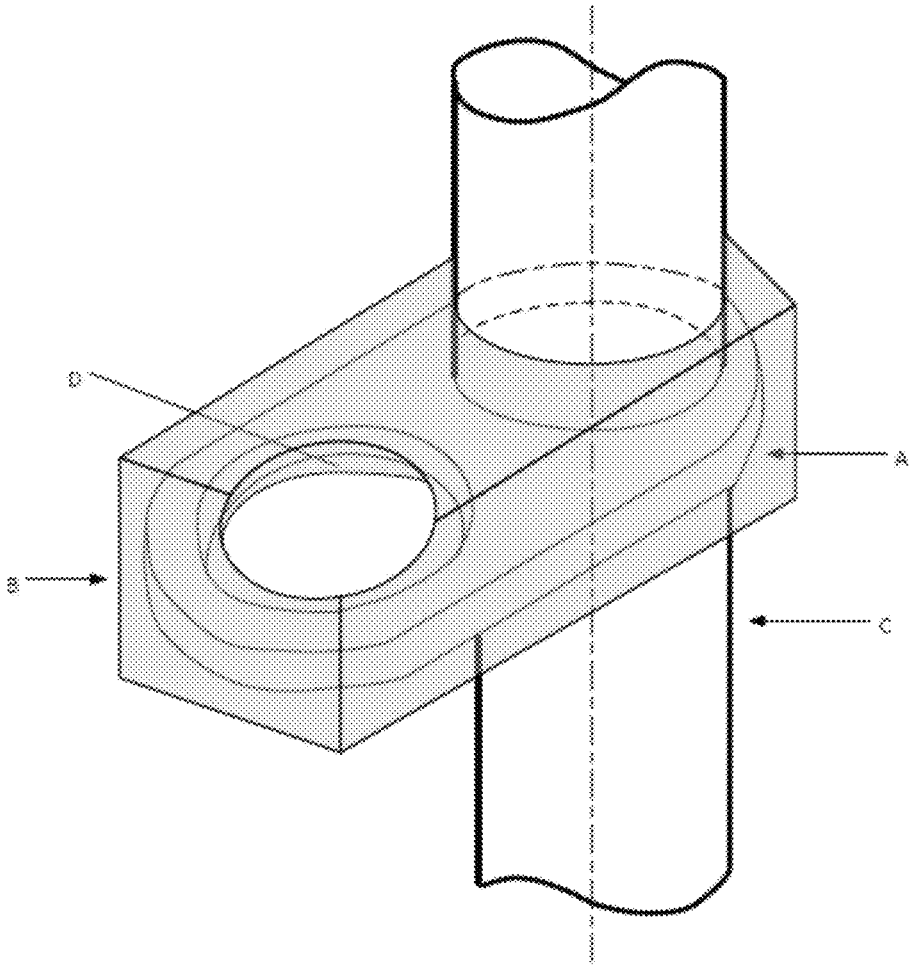
FIG. 5: An isometric view from the edge of the rooftop of strain indicator embodiment, the strain cover, fastened around the attachment device. The strain indicator material is shown in grey.

FIG. 5 is an isometric view from the edge of the rooftop of strain indicator embodiment, the strain cover, fastened around the attachment device. Components include (A) Attachment Device, (B) Strain Cover, (C) Vertical Structure Post, and (D) Strain Indicator Material. The strain indicator material is shown in grey.

Also incorporated in the design of the fall protection anchor is an integral degradable strain indicator material which in one embodiment is placed inside the attachment device which, after a certain amount of force indicative of a fall impact is reached, deforms giving a visual indication to safety inspectors that the system requires a thorough inspection. In an alternate embodiment the strain indicator can be formed into a housing which covers an attachment post and a portion of vertical structural post via one or more strain covers. These strain covers add the benefit of increasing the visible area of the strain indicator material in addition to ensuring that the orientation and location of the attachment device on the vertical structure post has not been tampered with or degraded after impact loading. This embodiment may be advantageous for more robust monitoring of potential damage to the attachment device and thus fall events. This monitoring is done by the strain covers being frangible, which may be easily degraded. The strain covers/strain indicator may be made of a composite material or other material such as Glass Fiber Reinforced Polymer (GFRP).

Figure 6:
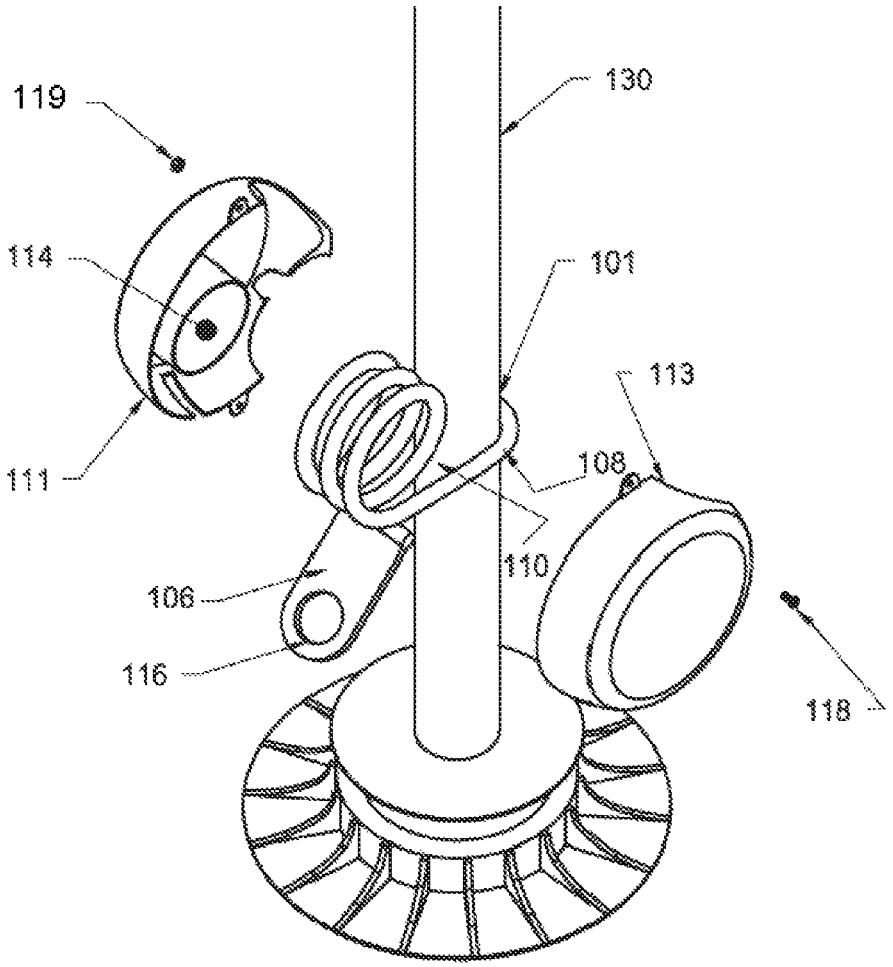
FIG. 6: An exploded perspective view showing the anchorage point hooking around the ballasted fall prevention apparatus' post with strain covers flanking a strain indicator. The rest of the fall prevention apparatus is omitted for clarity.

In one embodiment, FIG. 6, the anchorage connector 108 connects to the Ballasted Fall Prevention Apparatus 130 via a hook 101 which may be welded. The anchorage connector 108 is connected to the attachment device 106 and shock absorber 110 which may be coiled. Personal fall protection equipment 112 can be attached to the anchorage connector 108 via attachment device 106 and tie off points 116 as indicated. Two strain covers 111, 113 flank the shock absorber 110. When assembled, the strain covers 111, 113 become a strain indicator 120. On the inside of each strain cover 111, 113 is an integral hollow tube 114 to house the shock absorber 110. A nut 119 and bolt 118 secure the strain covers 111, 113 to the shock absorber 110. Other fasteners such as buckles may also be used. The rest of the ballasted fall prevention apparatus 130 is omitted for clarity.

Figure 7:
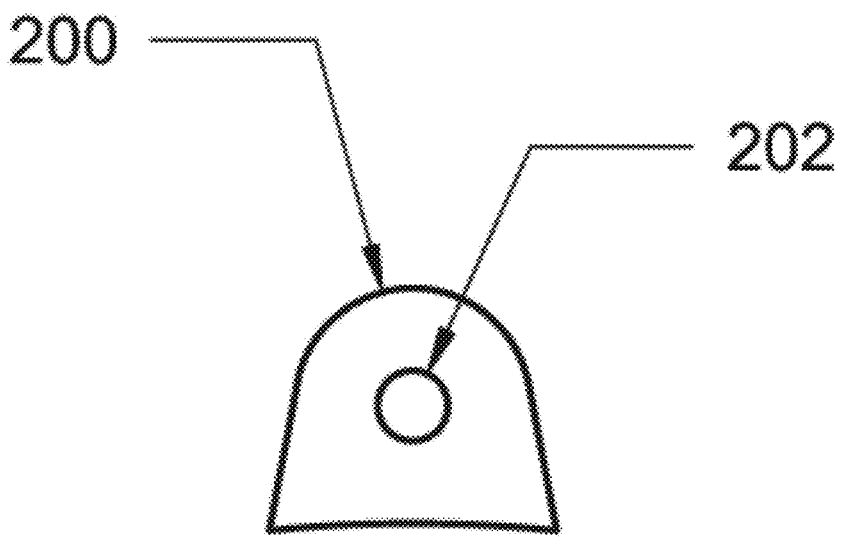
FIG. 7: An anterior view of the four lugs attached to the top and bottom ends of each of the two strain covers.
Figure 8A:
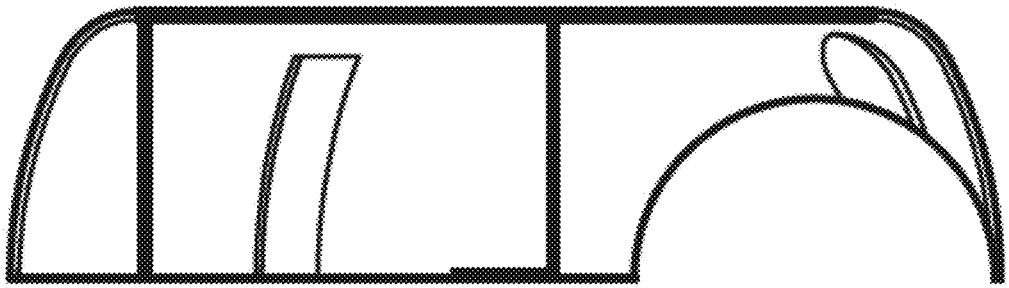
FIGS. 8A-8E: Various views of the strain covers including 8A Top, 8B Back, 8C Interior, 8D Front and 8E Interior.
Figure 8B:
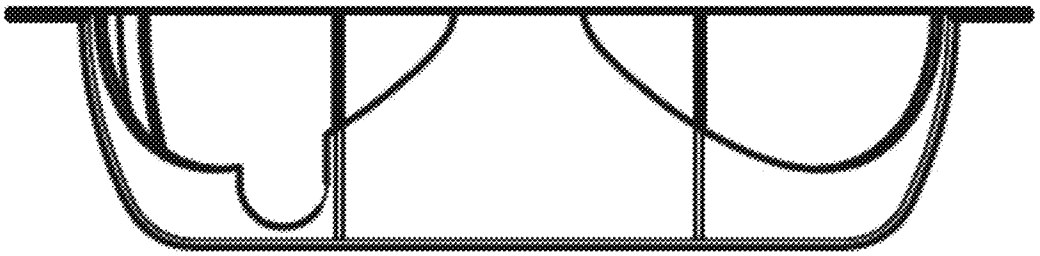
Figure 8C:
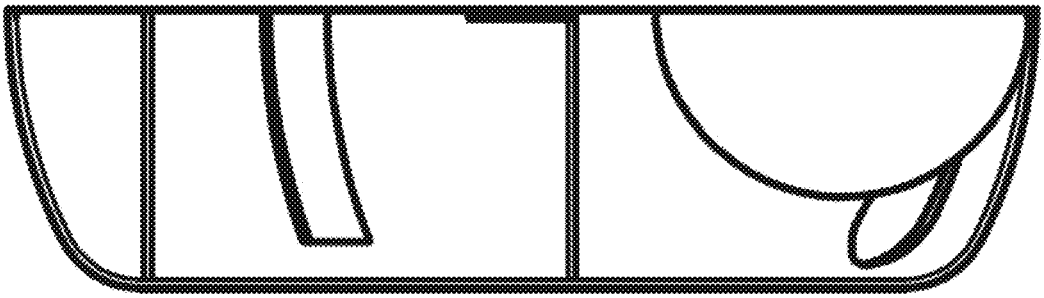
Figure 8D:
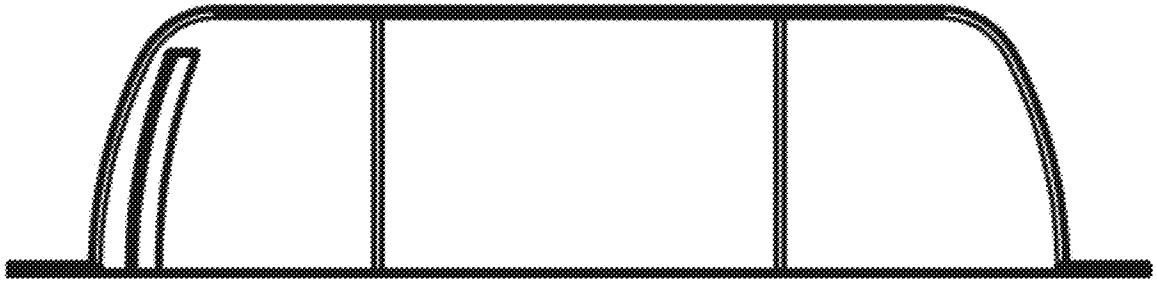
Figure 8E:
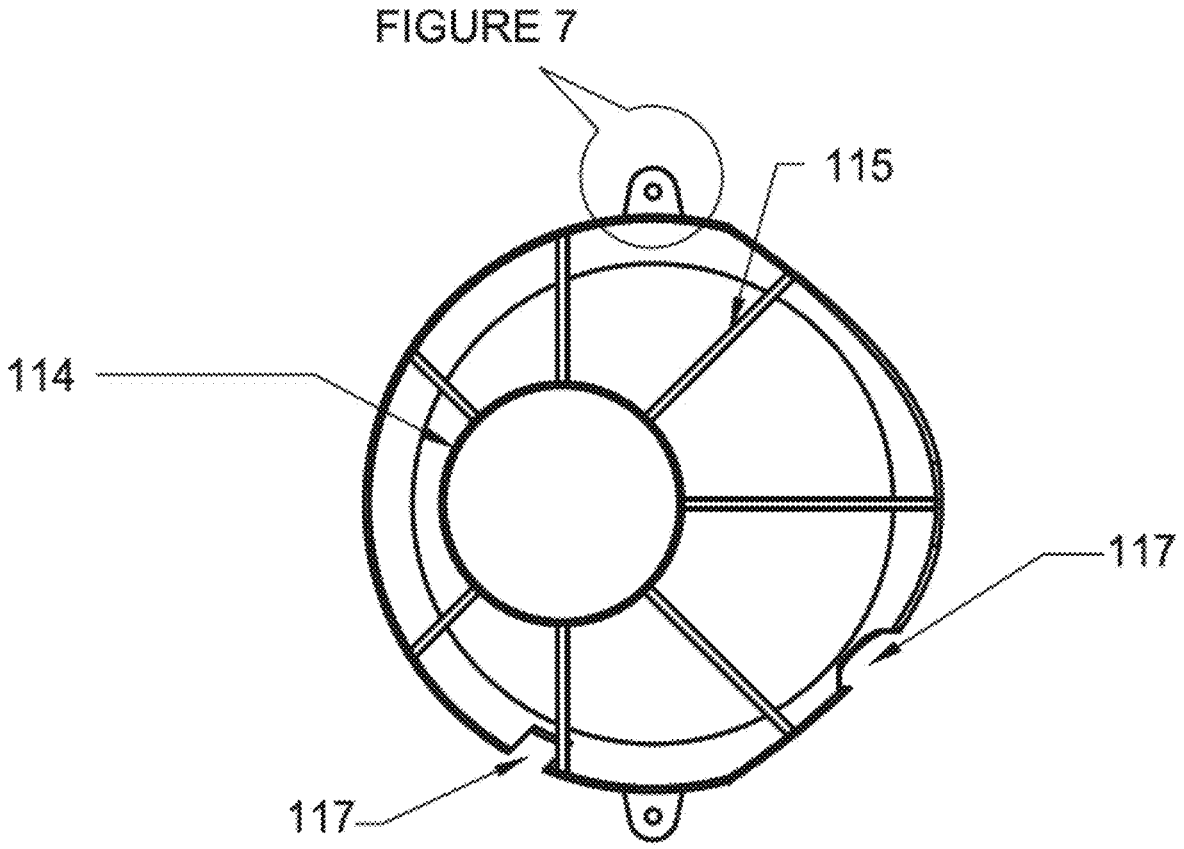

FIG. 7 is an anterior view of the four lugs 200 which attach to the two strain covers (at the top and bottom ends of each of the two strain covers). A hole 202 allows for insertion of the nut and bolt to secure the strain covers together. Other fasteners such as buckles may be used.

The strain covers are further detailed in FIG. 8 showing various views including elements (A) front view, (B) back view. (C) bottom view, (D) top view and (E) interior view. (E) also shows showing the lugs 200 at the top and bottom of the figure (refer to FIG. 7). A hollow tube 114 is at the center of the cover from which seven leading support ribs 115 radiate. Cut-out portions 117 allows the strain covers to secure over the strain indicator.

Figure 9A:
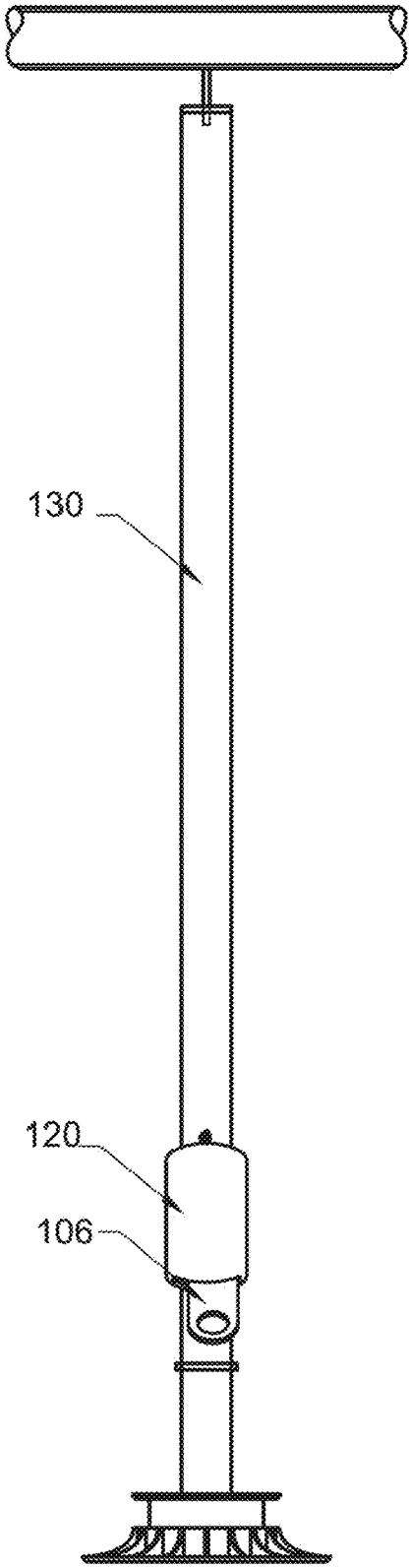
FIG. 9A: An anterior view of the post and Ballasted Fall Prevention Apparatus.
Figure 9B:
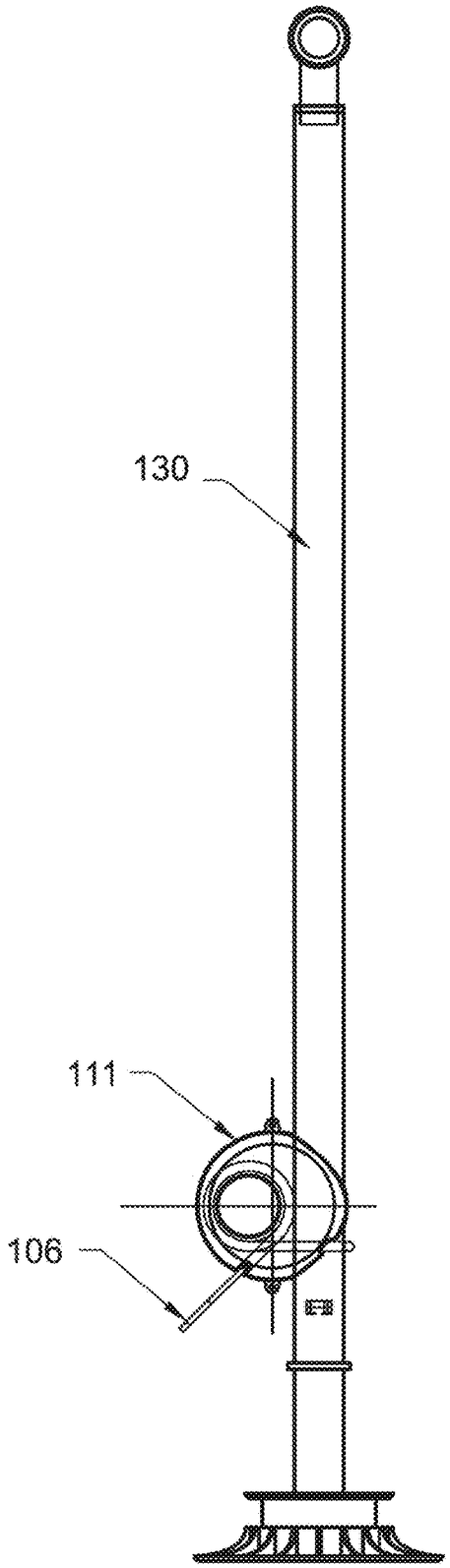
FIG. 9B: A posterior view of the post and Ballasted Fall Prevention Apparatus.
Figure 9C:
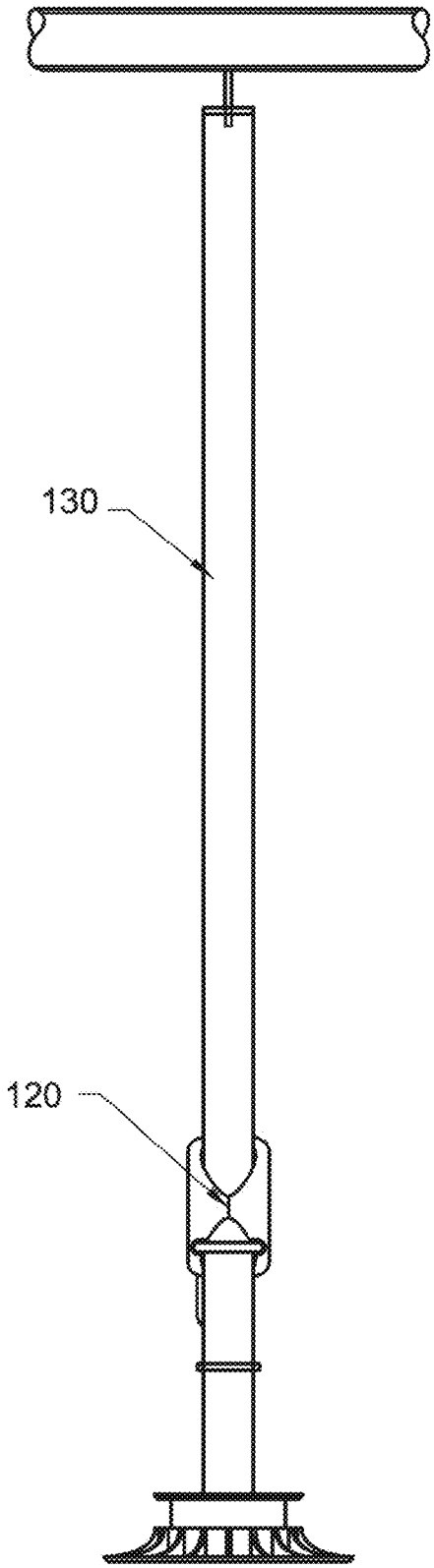
FIG. 9C: A left side view of the post and Ballasted Fall Prevention Apparatus.

The assembled apparatus is viewable in different ways. FIG. 9 shows elements (A) front, (B) posterior and (C) left side views of the Ballasted Fall Prevention Apparatus 130 including strain covers 111, 113 which combine to make strain indicator 120. Attachment device 106 is also shown.

Figure 10:
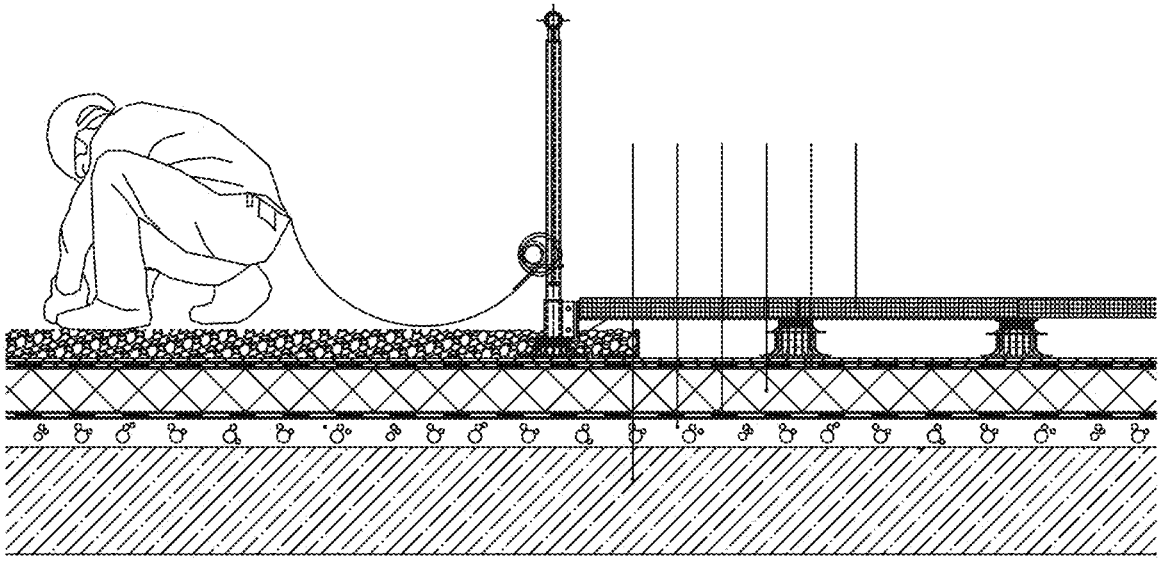
FIG. 10: A view of the Ballasted Fall Prevention Apparatus in use during work by maintenance personnel.

FIG. 10 is a view of the Ballasted Fall Prevention Apparatus in use, with the attachment device portion of the Ballasted Fall Prevention Apparatus connected to a maintenance worker via personal safety equipment. The maintenance worker is working on the rooftop edge, beyond the fall protection barrier.

Since the inventive principles of this patent disclosure can be modified in arrangement and detail without departing from the inventive concepts, such changes and modifications are considered to fall within the scope of the following claims.

The invention claimed is:

1. A rooftop safety system comprising:
- a ballasted fall prevention apparatus; and
- a fall protection anchor coupled to the ballasted fall prevention apparatus, the fall protection anchor further comprising:
  - an attachment device adapted to connect personal fall protection equipment to the fall protection anchor, wherein the attachment device comprises a first end of a multi-hole link;
  - an anchorage connector adapted to couple the fall protection anchor to the ballasted fall protection apparatus, wherein the anchorage connector comprises a second end of the multi-hole link; and
  - an integral strain indicator comprising a shock absorber coupling the attachment device to the anchorage connector, wherein the shock absorber is flanked by two or more strain covers, wherein:
    - the two or more strain covers are comprised of degradable material; and
    - the two or more strain covers degrade when a force associated with a fall event is applied to the fall protection anchor.

2. The rooftop safety system of claim 1 wherein the ballasted fall prevention apparatus comprises a handrail system.

3. The rooftop safety system of claim 1 wherein the fall protection anchor comprises a fall arrest anchor.

4. The rooftop safety system of claim 1 wherein the fall protection anchor comprises a fall restraint anchor.

5. The rooftop safety system of claim 1, wherein the fall protection anchor is integral with the ballasted fall prevention apparatus.

6. A fall protection anchor comprising:
- an attachment device adapted to connect personal fall protection equipment to the fall protection anchor, wherein the attachment device comprises a first end of a multi-hole link;
- an anchorage connector adapted to couple the fall protection anchor to a ballasted fall protection apparatus, wherein the anchorage connector comprises a second end of the multi-hole link; and
- an integral strain indicator comprising a shock absorber coupling the attachment device to the anchorage connector, wherein the shock absorber is flanked by two or more strain covers, wherein:
  - the two or more strain covers are comprised of degradable material; and
  - the two or more strain covers degrade when a force associated with a fall event is applied to the fall protection anchor.

7. The fall protection anchor of claim 6, wherein the integral strain indicator is coupled between the attachment device and the anchorage connector.

8. The fall protection anchor of claim 6, wherein the degradable material is arranged within one of the holes.

9. A method comprising coupling personal fall protection equipment to a ballasted fall prevention apparatus by a fall protection anchor, the fall protection anchor comprising:

an attachment device adapted to connect personal fall protection equipment to the fall protection anchor, wherein the attachment device comprises a first end of a multi-hole link;

an anchorage connector adapted to couple the fall protection anchor to the ballasted fall protection apparatus, wherein the anchorage connector comprises a second end of the multi-hole link; and an integral strain indicator comprising a shock absorber coupling the attachment device to the anchorage connector, wherein the shock absorber is flanked by two or more strain covers, wherein:

the two or more strain covers are comprised of degradable material, and the two or more strain covers degrade when a force associated with a fall event is applied to the fall protection anchor.

10. The method of claim 9 wherein the ballasted fall prevention apparatus comprises a handrail system.

11. The method of claim 9, wherein coupling personal fall protection equipment to the ballasted fall prevention apparatus comprises attaching personal fall protection equipment to the ballasted fall prevention apparatus via the fall protection anchor.

12. The method of claim 9 wherein coupling personal fall protection equipment to the ballasted fall prevention apparatus comprises:

coupling the fall protection anchor to the ballasted fall prevention apparatus; and coupling personal fall protection equipment to the fall protection anchor.

13. The method of claim 9 wherein the personal fall protection equipment includes a tie-off apparatus.

* * * * *